US005595699A

United States Patent [19]

Wright et al.

[11] Patent Number: 5,595,699

[45] Date of Patent: Jan. 21, 1997

[54] METHOD FOR SPINNING MULTIPLE COMPONENT FIBER YARNS

[75] Inventors: Donald E. Wright, Anderson, S.C.; William C. Flynn, III, Hendersonville, N.C.

[73] Assignee: BASF Corporation, Mt. Olive, N.J.

[21] Appl. No.: 472,280

[22] Filed: Jun. 7, 1995

[51] Int. Cl.[6] ..... D01D 1/10; D01D 4/06; D01D 5/08

[52] U.S. Cl. ..... 264/169; 264/176.1; 264/211

[58] Field of Search ..... 264/169, 171.1, 264/176.1, 211

[56] References Cited

U.S. PATENT DOCUMENTS

| | | | |
|---|---|---|---|
| Re. 35,108 | 12/1995 | Hagen et al. | 264/176.1 |
| 5,162,074 | 11/1992 | Hills | 216/83 |
| 5,234,650 | 8/1993 | Hagen et al. | 264/176.1 |

FOREIGN PATENT DOCUMENTS

| | | | |
|---|---|---|---|
| 676074 | 12/1963 | Canada | 264/169 |

*Primary Examiner*—Leo B. Tentoni
*Attorney, Agent, or Firm*—Nixon & Vanderhye P.C.

[57] ABSTRACT

A composite yarn formed of at least two different individual polymeric fibers may be spun by directing at least two streams of different polymer melts (e.g., polymer melts of different colors and/or characteristics) to a spin pack such that one of the streams has a greater volumetric throughput as compared to the volumetric throughput of the other stream. The polymer streams are each distributed within the spin pack among individual filtration chambers so that the filtration chambers receive substantially the same volumetric throughput allotment of the polymer melt streams. In such a manner, the polymer melt streams are distributed among the filtration chambers in substantially equal throughput allotments even though the total throughput of the melt streams of each of the different polymers may be unequal. The filtered polymer melt streams may then be directed through fiber-forming orifices of a spinneret plate to form the composite yarn.

7 Claims, 4 Drawing Sheets

METHOD FOR SPINNING MULTIPLE COMPONENT FIBER YARNS

CROSS-REFERENCE TO RELATED PATENTS

This application may be deemed related to prior-issued, commonly owned U.S. Pat. Nos. 5,162,074 issued on Nov. 10, 1992 to Hills et al entitled "Method of Making Plural Component Fibers", and 5,234,650 issued Aug. 10, 1993 to Hagen et al entitled "Method for Spinning Multiple Colored Yarn", the entire content of each patent being incorporated expressly herein by reference.

FIELD OF INVENTION

The present invention relates generally to the field of melt extrusion of fiber-forming polymers. More specifically, this invention relates to melt extrusion to form multicomponent (i.e., multicolored) yarn.

BACKGROUND AND SUMMARY OF THE INVENTION

Spin packs which are capable of spinning multiple component fibers are known, for example, through the above-cited Hills et al '074 and Hagen et al '650 patents. One problem that may exist, however, with conventional multiple component spin packs is premature spin pack downtime necessitated by plugging of filter elements associated with the polymer component having the higher throughput. That is, when spinning multiple component fibers, one or more of the individual polymer components (e.g., polymer components of different color) may have a greater spin pack throughput as compared to the spin pack throughput of other individual polymer components. Thus, while the filter elements adequately continue to filter that one (or more) individual polymer component having lesser spin pack throughput, the filter elements which filter the polymer component(s) having the greater polymer throughput have a propensity to clog thereby necessitating spin pack down time for service and/or cleaning. Also, some pigments require more filtration area than others even at the same throughputs.

According to the present invention, however, polymer throughputs of individual polymer components forming a multicomponent polymeric fiber are substantially equalized for purposes of filtration, even though the total throughput of one of the individual polymer components is greater/lesser as compared to the throughput of at least one other polymer component. That is, any unequal throughput of the polymer streams employed to form multiple polymer component yarn is, according to the present invention, equalized for purposes of polymer filtration within the spin pack.

More specifically, according to the present invention, at least two different individual polymeric fibers may be spun by directing at least two streams of different polymer melts (e.g., polymer melts of different colors) to a spin pack such that one of the streams has a greater volumetric throughput as compared to the volumetric throughput of the other stream. The polymer streams are each distributed within the spin pack among individual filtration chambers so that each such filtration chamber receives substantially the same volumetric throughput of the polymer melt streams. In such a manner, the polymer melt streams are distributed among the filtration chambers in substantially equal throughput allotments even though the total throughput of the melt streams of each of the different polymers may be different. The filtered polymer melt streams may then be directed through fiber-forming orifices of a spinneret plate to form the composite yarn.

These and other advantages of the invention will become more clear from the following detailed description of the preferred exemplary embodiment thereof which follows.

BRIEF DESCRIPTION OF THE DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1:
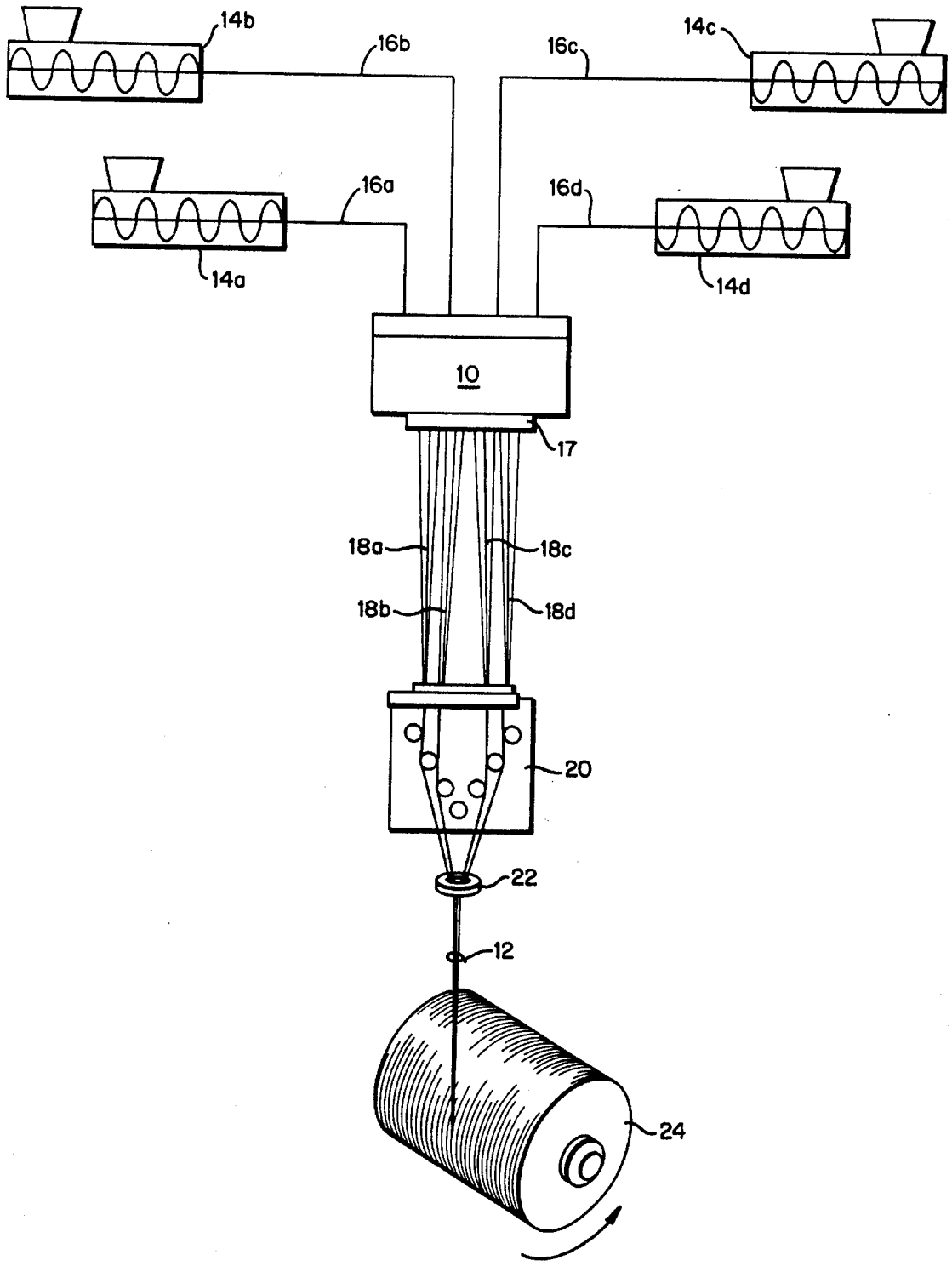
FIG. 1 is a schematic view of a system that may be employed to spin a multiple component yarn.

Accompanying FIG. 1 shows a exemplary system in which the spin pack 10 according to this invention may be employed so as to form a multiple component yarn 12. More specifically, individual different polymer components are rendered molten by extruders **14*a*–14*d* and introduced into the spin pack 10 via lines 16*a*–16*d*, respectively. The molten polymer components will be extruded through individual orifices each having respective individual back holes associated spinneret plate 17 of the spin pack 10. Thus, individual fiber streams 18*a*–18*d* corresponding respectively to the individual polymer components will be issued from the spinneret plate 17. The individual fibers may thus be directed over a suitable guide structure 20 and gathered at ring 22 so as to form the multiple component yarn 12 which is taken up on a bobbin 24**.

As may be appreciated, if the individual polymer streams **16*a*–16*d* are constituted by individual differently colored molten polymers, then the yarn 12 which is formed downstream of the spinneret will be a composite of the individual differently colored fibers. Therefore, by increasing/decreasing the number of individual fibers of one color in the yarn 12, a different visual color hue or characteristic (e.g., a "heather-type" yarn) will be achieved. This different visual color hue or characteristic may thus be achieved by the techniques generally described in the above-mentioned Hagen et al '650 patent—that is, by providing the means for selecting which, if any, mutually separated molten polymer in the streams 16*a*–16*d* flows into which orifice backhole of the spinneret 17. Thus, it is entirely possible (and in fact typical) for one of the polymer streams 16*a*–16*d* to be introduced at a greater throughput as compared to others of the polymer streams 16*a*–16*d***.

According to the present invention, however, the unequal throughput of the polymer streams **16*a*–16*d* is equalized for purposes of polymer filtration within the spin pack 10. This filtration throughput equalization is preferably accomplished using the structures depicted in accompanying FIGS. 2–4**.

Figure 3:
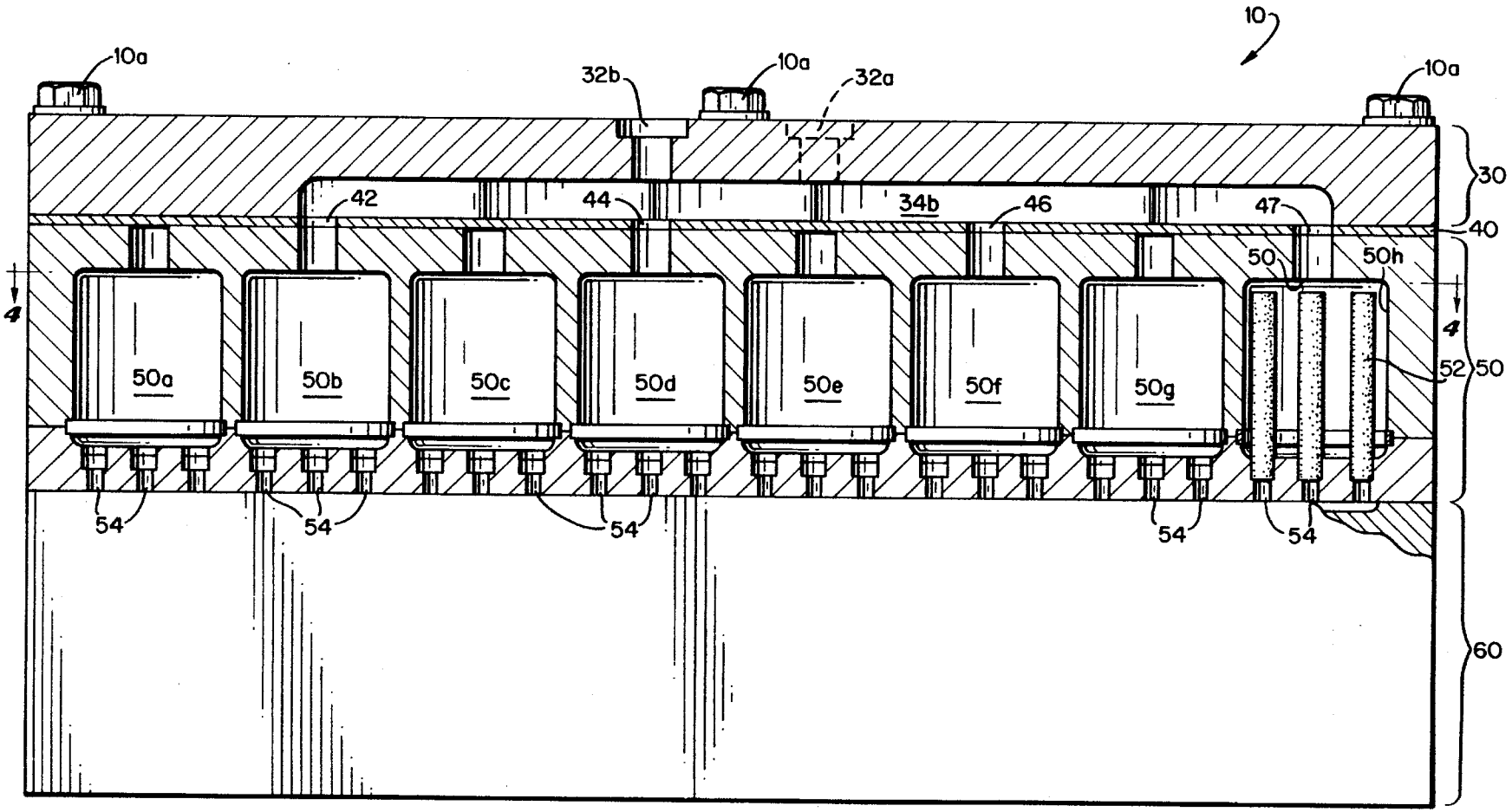
FIG. 3 is a partial cross-sectional elevational view of the spin pack shown in FIG. 2 as taken along line 3—3 therein.

As seen particularly in FIG. 3, the spin pack 10 according to the exemplary embodiment depicted therein includes a manifold plate 30, a distribution plate 40, a filtration housing 50 and a selection assembly 60 formed of one or more selection plates as described more fully in the above-cited Hagen et al '650 patent. These structural components are sandwiched together to form the spin pack 10 using bolt assemblies 10*a*.

Figure 2:
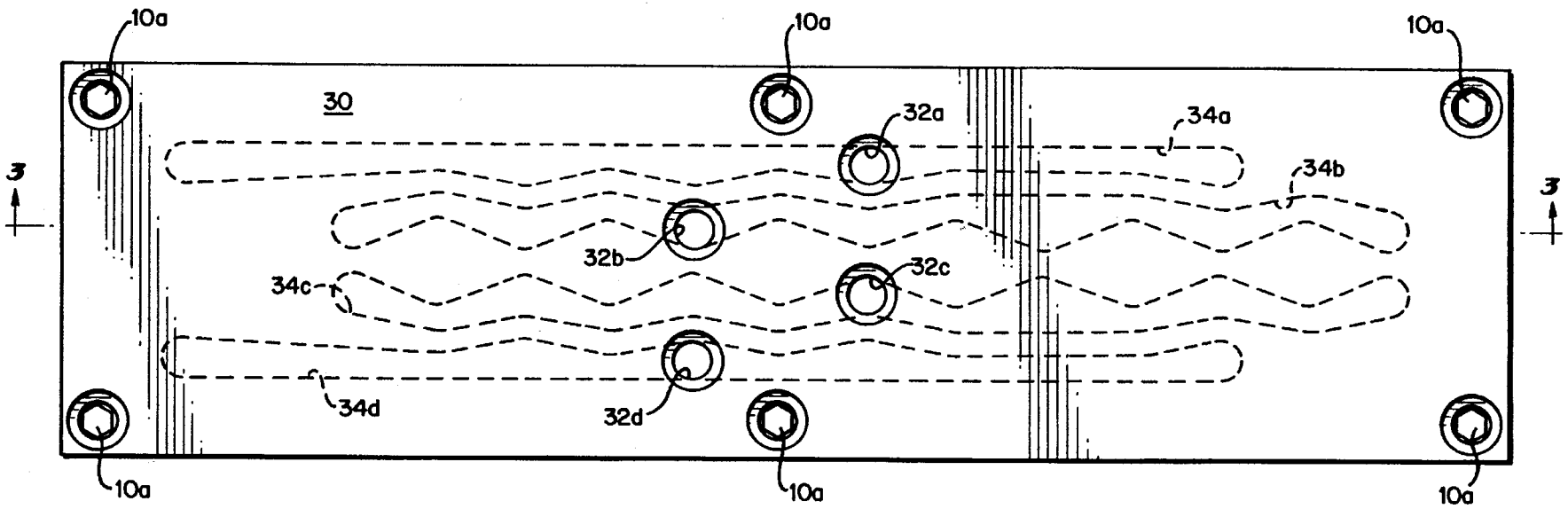
FIG. 2 is a top plan view of a particularly preferred spin pack embodiment according to the present invention.

As is perhaps best shown by FIG. 2, the manifold plate 30 includes polymer ports 32*a*–32*d* which receive molten polymer as an input from polymer streams 16*a*–16*d*, respectively. Each of the ports 32*a*–32*d* communicates with a respective one of the polymer distribution channels 34*a*–34*d*, respectively, formed in the bottom surface of the manifold plate 30.

The distribution channels 34*a*–34*d* extend so as to be capable of communication with respective groupings of filtration chambers 50*a*–50*p*. Selective communication between the distribution channels 34*a*–34*d* and selected ones of the filtration chambers 50*a*–50*p* is established by apertures associated with the distribution plate 40. For example, as shown in FIG. 3, the distribution plate 40 includes four apertures 42, 44, 46 and which direct molten polymer from the distribution channel 34*b* into only four of the equal volume filtration chambers 50*a*–50*p* formed in the selection assembly 50—that is, into filtration chambers 50*b*, 50*d*, 50*f* and 50*h*, respectively. Similarly, the distribution plate 40 will include additional apertures in fluid communication with all of the remaining channels 34*a*, 34*c* and/or 34*d* so as to direct molten polymer into selected ones of the remaining filtration chambers 50*a*, 50*c*–50*e*, 50*g* and/or 50*i*–50*p* as may be desired for a given yarn product.

In other words, the location and number of apertures in the distribution plate 40 will allow the polymer throughput for a given molten polymer to be divided evenly among one or more of the filtration chambers 50*a*–50*p* so that the polymer throughput relative to any given one of the filtration chambers 50*a*–50*p* is substantially equivalent to the polymer throughput relative to any other one of the filtration chambers 50*a*–50*p*. As a specific example, if molten polymer entering the spin pack via ports 32*a*, 32*d* each represents twice the throughput as compared to polymer entering the spin pack via ports 32*b*, 32*c*, then the apertures must be formed in the distribution plate 40 so that each such polymer stream is distributed among twice the number of filtration chambers 50*a*–50*p* as compared to the number of filtration chambers 50*a*–50*p* to which the polymers entering the spin pack via ports 32*b*, 32*c* is distributed.

Figure 4:
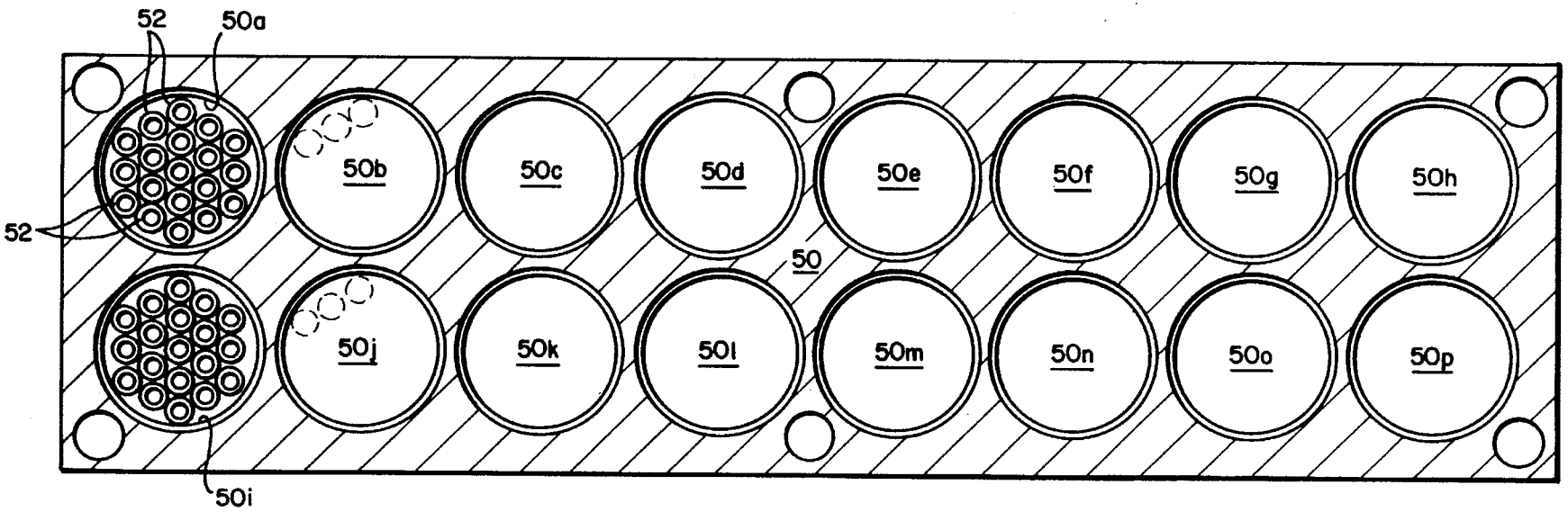
FIG. 4 is a cross-sectional plan view of the spin pack shown in FIG. 3 as taken through the individual filtration chambers along line 4—4 therein.

In any case, the molten polymer is filtered through a number of individual candle filters provided in each of the filtration chambers 50*a*–50*b*, a few such candle filters being shown in FIGS. 3 and 4 by reference numeral 52. Once the filtered polymer exits the filtration chambers 50*a*–50*p* through individual outlet channels 54 associated with each of the candle filters 52, the filtered polymer may then be recombined as needed by the channels (not shown) formed within the selection assembly 60 as described more fully in the above-cited Hagen et al '650 patent. As such, the filtered polymer streams may be directed to the orifices in the spinneret plate 17 (see FIG. 1) in virtually any desired pattern and/or order.

As should now be appreciated, a principal functional attribute of this invention allows polymer streams of unequal throughput to be subjected to substantially equalized throughput for purposes of filtration. In addition, more uniform polymer residence time within the filtration chambers may be achieved. This substantial equalization of polymer throughput and/or more uniform polymer residence time therefore allows each of the filter elements (e.g., the candle filters 52) to be individually exposed to substantially the same volume of polymer melt per unit time thereby decreasing the likelihood that the filter elements will become prematurely plugged (which could otherwise be the case if some of the filter elements were required to filter an unequal volume of polymer melt per unit time as compared to other filter elements).

Therefore, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of spinning composite yarn having at least two different individual polymeric fibers comprising the steps of:

(i) directing at least two streams of different polymer melts to a spin pack such that one of the streams has a greater volumetric throughput as compared to the volumetric throughput of the other streams;

(ii) distributing said at least two streams within the spin pack among individual filtration chambers so that each such filtration chamber receives substantially the same volumetric throughput of the polymer melt streams;

(iii) filtering the polymer melt streams within the filtration chambers by directing the polymer melt streams therewithin through filter elements;

(iv) directing the filtered polymer melt streams through fiber-forming orifices of a spinneret plate to form the composite yarn.

2. The method of claim 1, wherein step (iii) includes directing the polymer melt stream though individual candle filters positioned within each of the filtration chambers.

3. The method of claim 1, wherein step (ii) includes providing a manifold plate which directs each of the polymer streams to respective ones of the filtration chambers.

4. The method of claim 3, which includes interposing an apertured distribution plate between the manifold plate and the filtration chambers so that the respective polymer streams are directed to selected ones of the filtration chambers.

5. The method of claim 4, wherein the distribution plate has apertures which distributes at least one of the polymer streams to at least two non-adjacent ones of the filtration chambers.

6. The method of claim 1, wherein step (iv) includes recombining filtered polymer streams discharged from the filtration chambers, and then directing the recombined filtered polymer streams to selected orifices of the spinneret.

7. The method of claim 1 wherein the polymer melt streams are different colors.

* * * * *